US008072395B2

(12) United States Patent
Kim

(10) Patent No.: US 8,072,395 B2
(45) Date of Patent: Dec. 6, 2011

(54) PLASMA DISPLAY APPARATUS AND METHOD OF DRIVING

(75) Inventor: Young Dae Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 713 days.

(21) Appl. No.: 11/748,721

(22) Filed: May 15, 2007

(65) Prior Publication Data

US 2007/0262924 A1 Nov. 15, 2007

(30) Foreign Application Priority Data

May 15, 2006 (KR) ..... 10-2006-0043604

(51) Int. Cl.
*G09G 3/28* (2006.01)

(52) U.S. Cl. ..... 345/60; 315/169.4

(58) Field of Classification Search ..... 345/60–72, 345/204, 690; 315/169.4
See application file for complete search history.

(56) References Cited

U.S. PATENT DOCUMENTS

| | | | | |
|---|---|---|---|---|
| 6,624,798 | B1 * | 9/2003 | Aoki et al. | 345/60 |
| 7,619,588 | B2 * | 11/2009 | Yang et al. | 345/67 |
| 2002/0140367 | A1 | 10/2002 | Matsumoto | |
| 2005/0077836 | A1 | 4/2005 | Jin et al. | |
| 2005/0110706 | A1 | 5/2005 | Kim | |
| 2006/0001603 | A1 * | 1/2006 | Kang et al. | 345/60 |
| 2006/0044221 | A1 * | 3/2006 | Kim et al. | 345/60 |
| 2006/0077130 | A1 * | 4/2006 | Rhee | 345/60 |

FOREIGN PATENT DOCUMENTS

| | | |
|---|---|---|
| CN | 1619614 | 5/2005 |
| CN | 1716360 | 1/2006 |
| EP | 837443 A1 | 4/1998 |
| EP | 1722350 A1 | 11/2006 |
| JP | 2004-212699 A | 7/2004 |
| KR | 10 2004 0087116 | 10/2004 |
| KR | 10 2005 0049676 | 5/2005 |

OTHER PUBLICATIONS

Chinese Patent Application No. 200780001382.8 dated Dec. 4, 2009 (12 pages) (English Translation).
International Search Report (Application No. PCT/KR2007/002386), dated Aug. 28, 2007, 2 pages.
European Office Action for Patent Application No. 07746534.2 mailed Sep. 15, 2010 (11 pages).

* cited by examiner

*Primary Examiner* — Stephen Sherman
(74) *Attorney, Agent, or Firm* — Fish & Richardson P.C.

(57) ABSTRACT

A plasma display apparatus includes a data driver and a plasma display panel having a first address electrode and a second address electrode. The data driver is configured to initiate a change in a voltage value of a first data signal supplied to the first address electrode at a first initiation time, and to initiate a change in a voltage value of a second data signal supplied to the second address electrode at a second, different initiation time. Each of the data signals gradually changes from a first data voltage to a second data voltage during a respective first period, maintains at the second data voltage during a respective second period, and gradually changes from the second data voltage to a third data voltage during a respective third period.

26 Claims, 15 Drawing Sheets

PLASMA DISPLAY APPARATUS AND METHOD OF DRIVING

This application claims the benefit of Korean Patent Application No. 10-2006-0043604 filed on May 15, 2006, which is hereby incorporated by reference.

BACKGROUND

1. Technical Field

This document is related to driving a plasma display apparatus.

2. Description of the Related Art

A plasma display apparatus includes a plasma display panel having electrodes and a driver that supplies driving signals to the electrodes. The plasma display panel includes discharge cells partitioned by a barrier rib. Phosphor is formed within the discharge cells.

When certain driving signals are supplied to the electrodes of the plasma display panel, a sustain discharge is generated within a discharge cell. As a result of the sustain discharge, discharge gas in the discharge cell generates vacuum ultraviolet rays that cause the phosphor to emit light.

Before an occurance of the sustain discharge, a reset discharge initializing wall charges of the discharge cell, and an address discharge selecting a discharge cell where a sustain discharge will occur are generated within the discharge cell.

SUMMARY

In one general aspect, a plasma display apparatus includes a data driver and a plasma display panel having first and second address electrodes. The data driver is configured to initiate a change in a voltage value of a first data signal supplied to the first address electrode at a first initiation time, and to initiate a change in a voltage value of a second data signal supplied to the second address electrode at a second, different initiation time. Each of the data signals gradually changes from a first data voltage to a second data voltage during a respective first period, maintains at the second data voltage during a respective second period, and gradually changes from the second data voltage to a third data voltage during a respective third period.

In another general aspect, driving a plasma display apparatus includes initiating a change in a voltage value of a first data signal supplied to a first address electrode at a first initiation time, and initiating a change in a voltage value of a second data signal supplied to a second address electrode at a second, different initiation time. Each of the data signals gradually changes from a first data voltage to a second data voltage during a respective first period, maintains at the second data voltage during a respective second period, and gradually changes from the second data voltage to a third data voltage during a respective third period.

Implementations may include one or more of the following features. For example, the first data voltage and the third data voltage may be substantially the same. Also, the first and second address electrodes may be adjacent to each other. The difference between the first initiation time and the second initiation time may range from 0.2 times to 1 times the duration of the first period for the first data signal. The time difference between the first and second initiation times may range from 10 ns to 300 ns.

The duration of the respective first period may be between 5% and 20% of the duration of the respective second period.

In terms of slopes, the slope of each of the data signals during the respective first period may range between 0.1V/ns and 1V/ns.

A scan driver may initiate a change in a voltage value of a scan signal supplied to a scan electrode at a third initiation time. The scan signal may gradually change from a first scan voltage to a second scan voltage during a fourth period, maintain at the second scan voltage during a fifth period, and gradually change from the second scan voltage to a third scan voltage during a sixth period. The slope of the scan signal during the fourth period may be different from the slope of the first data signal during the first period. The third initiation time may be different from the first and second initiation times.

Other features will be apparent from the following description, including the drawings, and the claims.

DETAILED DESCRIPTION

Figure 1:
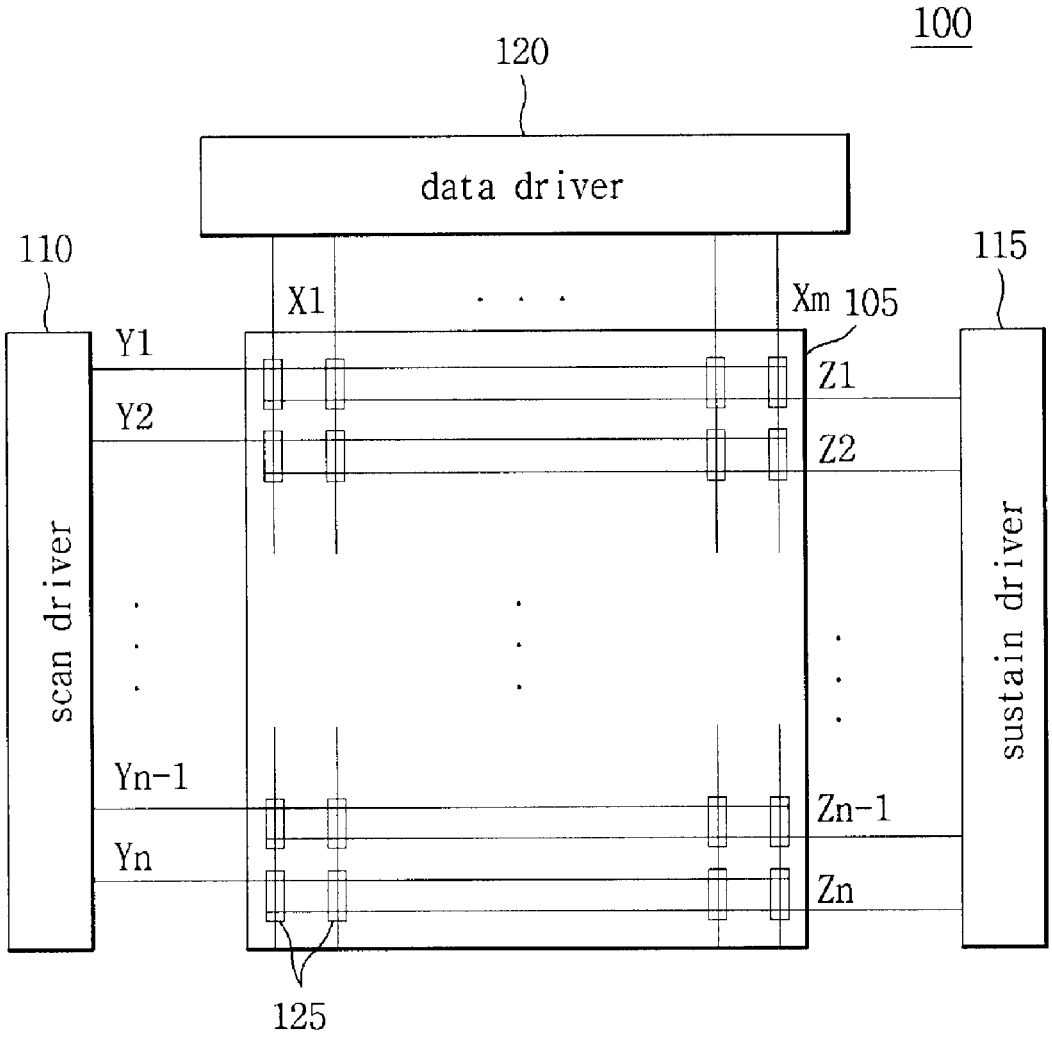
FIG. 1 is a block diagram of a plasma display apparatus.

FIG. 1 illustrates a plasma display apparatus 100 that includes a plasma display panel 105, a scan driver 110, a sustain driver 115, and a data driver 120.

The plasma display panel 105 includes discharge cells 125, scan electrodes Y1, . . . , Yn, sustain electrodes Z1, . . . , Zn, and address electrodes X1, . . . , Xm, including first and second address electrodes X1 and X2 that are adjacent to each other.

The scan driver 110 supplies, to the scan electrodes Y1, . . . , Yn, a reset signal initializing the wall charge state of discharge cells, a scan signal selecting discharge cells to emit light, and a sustain signal that causes the emission of light from the selected discharge cells.

The sustain driver 115 supplies, to the sustain electrodes Z1, . . . , Zn, a sustain bias signal that helps the selection of the discharge cells and a sustain signal that causes emission of light from the selected discharge cells.

The data driver 120 supplies data signals to the address electrodes X1, . . . , Xm at different supply time points. The data signals gradually rise to a data voltage during a first period, are maintained at the data voltage during a second period, and gradually fall from the data voltage during a third period. The address electrodes include a first address electrode and a second address electrode. The data driver 120 supplies a first data signal to the first address electrode, and a second data signal to the second address electrode. The supply start time point of the second data signal, which is the point in time when the first data signal starts to rise in the first period, is different from the supply start time point of the first data signal. The first data signal or the second data signal gradually rises to the data voltage during a first period, is maintained at the data voltage during a second period, and gradually falls from the data voltage during a third period.

The scan driver 110 supplies a scan signal corresponding to the first data signal and the second data signal.

Figure 2:
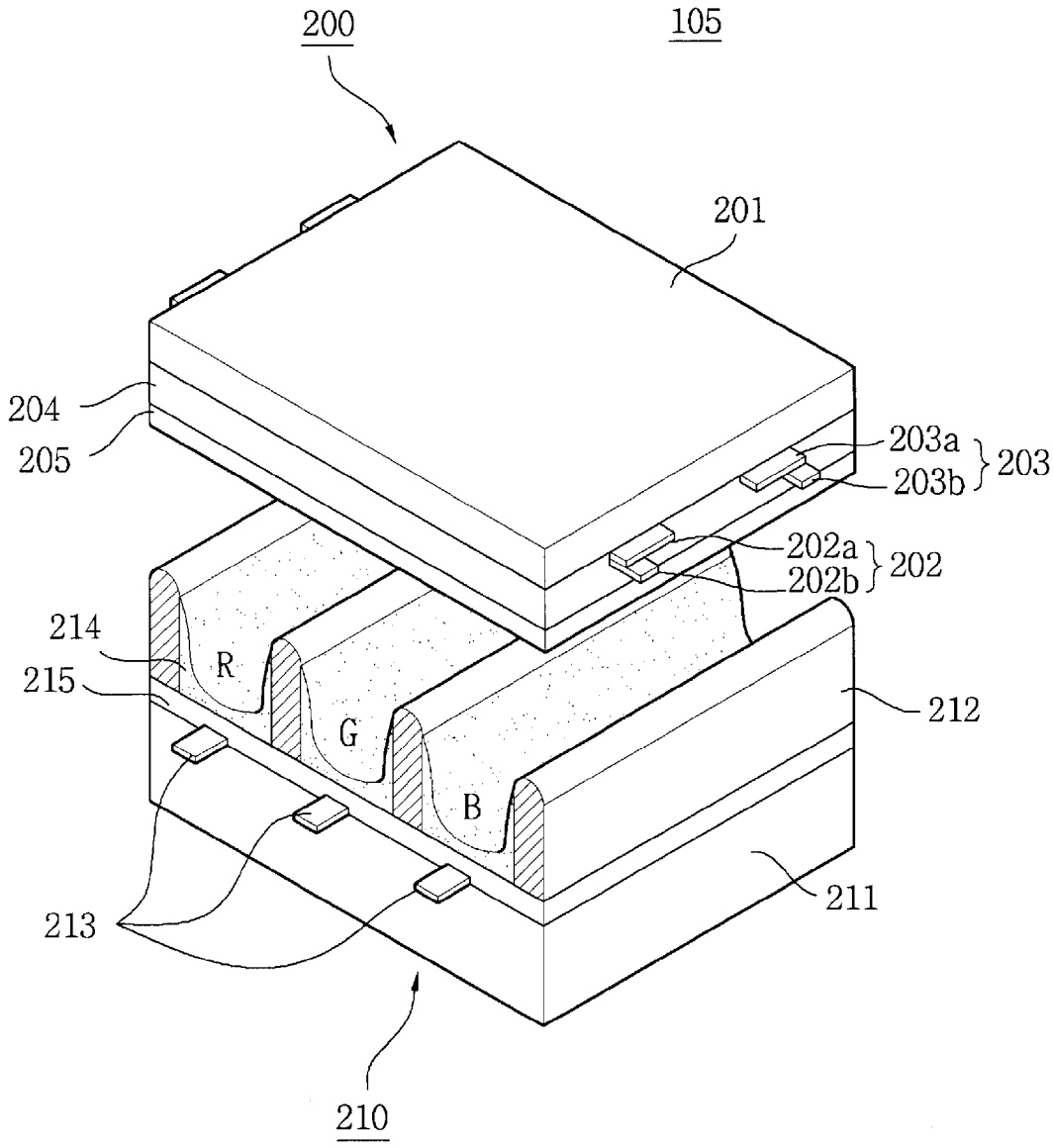
FIG. 2 is a perspective view of a plasma display panel of the plasma display apparatus of FIG. 1.

FIG. 2 illustrates a perspective view of an exemplary plasma display panel of a plasma display apparatus. As illustrated in FIG. 2, the plasma display panel 105 includes a front panel 200 and a rear panel 210. The front panel 200 includes a front substrate 201 on which a scan electrode 202 and a sustain electrode 203 are formed. The rear panel 210 includes a rear substrate on which address electrodes 213 crossing the scan electrode 202 and the sustain electrode 203 are formed.

An upper dielectric layer 204 covers the scan electrode 202 and the sustain electrode 203.

The scan electrode 202 and the sustain electrode 203 may include transparent electrodes 202*a* and 203*a* and bus electrodes 202*b* and 203*b*. The transparent electrodes 202*a* and 203*a* are made of Indium Tin Oxide. The bus electrodes 202*b* and 203*b* improve the electric conductivity.

Alternatively, the scan electrode 202 and the sustain electrode 203 of FIG. 2 may includes only the bus electrodes 202*b* and 203*b*.

The upper dielectric layer 204 limits a discharge current of the scan electrode 202 and the sustain electrode 203, and insulates the scan electrode 202 and the sustain electrode 203. The upper dielectric layer 204 comprises a glass material including $R_2O$ and metal oxide $MO_2$.

The metal oxide $MO_2$ includes at least one of $MnO_2$, $CeO_2$, $SnO_2$, or $SbO_2$, each of which has 3 or 4 valence. $R_2O$ includes at least one of $Li_2O$, $Na_2O$, $K_2O$, $Rb_2O$, $Cs_2O$, $Cu_2O$, or $Ag_2O$. $MO_2$ prevents Ag ions or Cu ions of the scan electrode 202 or the sustain electrode 203 from diffusing throughout the upper dielectric layer 204. Accordingly, a discoloration of the upper dielectric layer 204 204 is prevented. $MO_2$ may range from 0.5 wt % to 10 wt % of the total weight of the dielectric layer. When $MO_2$ ranges from 0.5 wt % to 10 wt % of the total weight of the dielectric layer, $R_2O$ decreases the softening point of a glass, and improves the liquidity of the glass.

A protective layer 205 is positioned on the upper dielectric layer 204, and improves a discharge condition. The protective layer is formed by the diposition of magnesium oxide MgO.

The address electrodes 213 supply data signals to discharge cells. A lower dielectric layer 215 covers the address electrodes 213, and insulates the address electrodes 213.

The lower dielectric layer 215 includes PbO, SiO2, B2O3, $Al_2O_3$ and CuO. CuO may range from 0.2 wt % to 0.4 wt % of the total weight of the lower dielectric layer 215. CuO decreases the viscosity of a dielectric paste. Accordingly, when CuO ranges from 0.2 wt % to 0.4 wt % of the total weight of the lower dielectric layer 215, CuO prevents the generation of bubbles inside the lower dielectric layer 215, and thereby decreases the necessary driving voltage. As a result of the decrease of the driving voltage, noise and electromagnetic interference are reduced.

A stripe type barrier rip or a well type barrier rib 212 is formed on the lower dielectric layer 215. The barrier rib partitions discharge cells. A discharge gas is filled in the discharge cells. A phosphor 214 is formed within the discharge cells.

Figure 3:
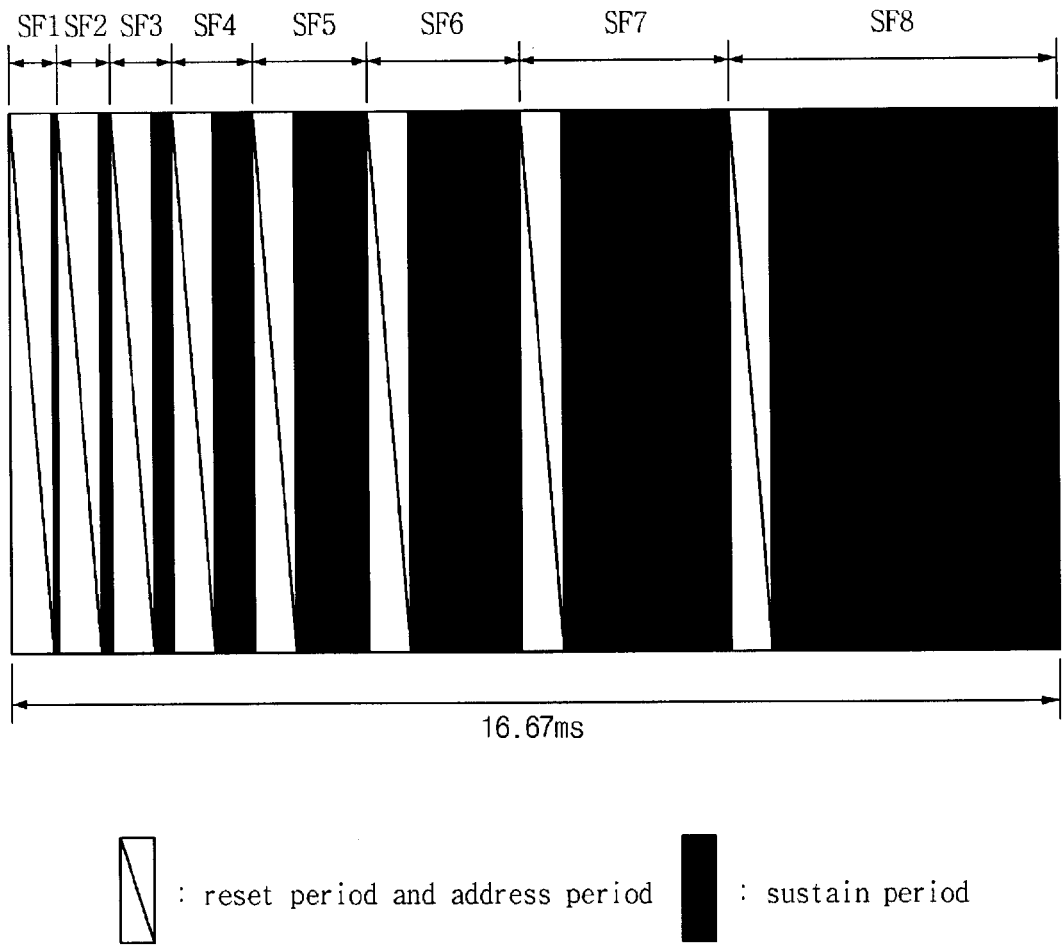
FIG. 3 is a timing diagram of signals of the plasma display apparatus of FIG. 1.

FIG. 3 explains an exemplary method of implementing gray scales in the plasma display apparatus.

As shown in FIG. 3, in order to implement the gray scale, each image frame is divided into sub-fields SF1 to SF8. Each sub-field is also divided into a reset period for initializing all of the discharge cells, an address period for selecting discharge cells to emit light, and a sustain period for emitting light from the selected discharge cells. The sub-fields have different durations of the sustain periods. The grey scale of each discharge cell is implemented by selecting some sub-fields to emit light with proper durations of the sustain periods. For example, if it is desired to display an image with 256 gray scales, a frame period (16.67 ms) corresponding to 1/60 of a second is divided into eight sub-fields SF1 to SF8.

The time duration and the number of sustain pulses that are associated with each sustain period increase by the ratio of 2n (where, n=0, 1, 2, 3, 4, 5, 6, 7) for each sub-field SF1 to SF8. For example, the duration of the sustaion period of sub-field SF2 is twice the duration of the sustaion period of sub-field SF1. As such, since the duration of the sustain period varies from one sub-field to the next, the gray scale of a discharge cell is achieved by controlling which sustain periods are to be used to emit light from the discharge cell, i.e., by controlling the number of the sustain discharges that are realized in the discharge cell.

Figure 4A:
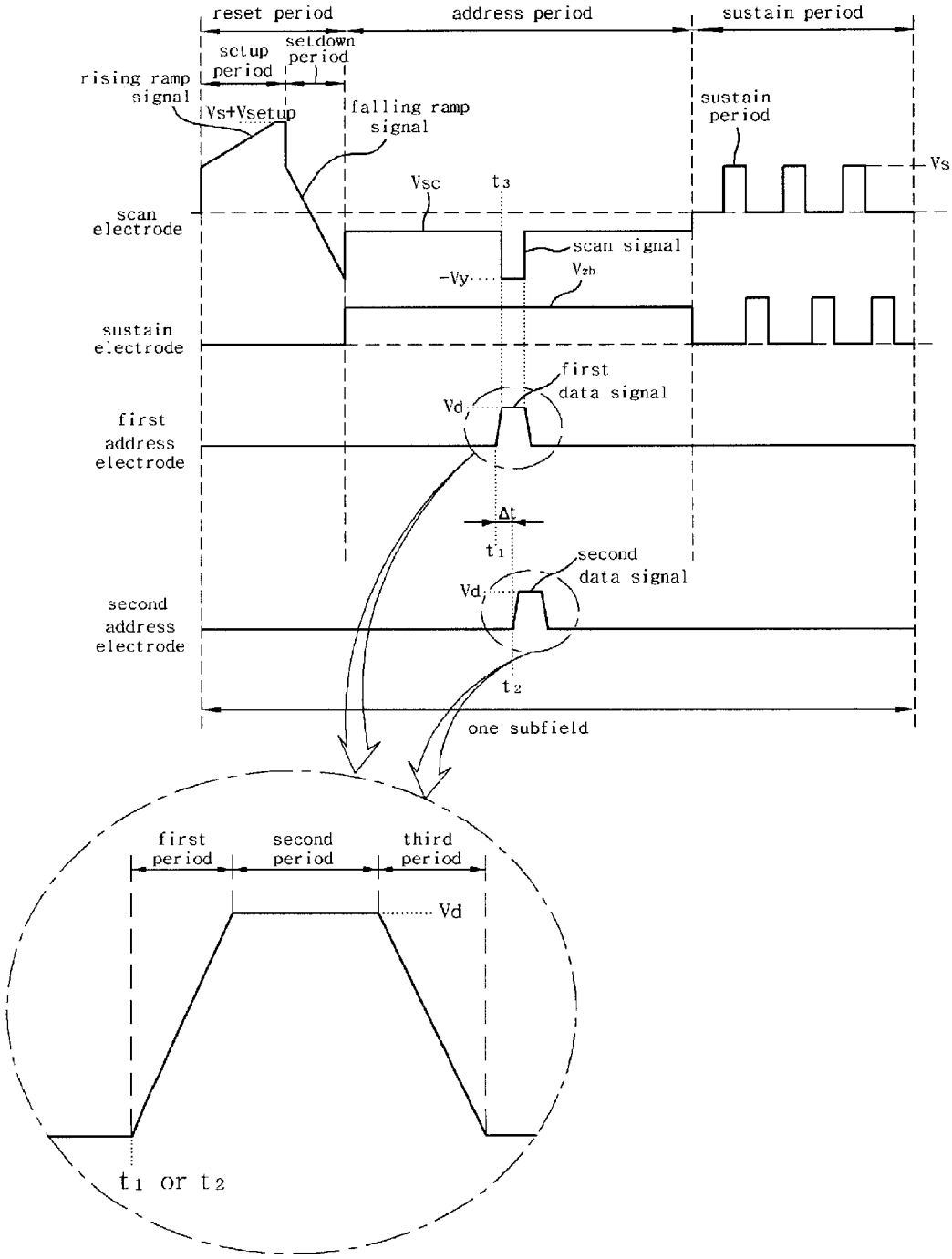
FIG. 4*a* is a graph of driving signals of the plasma display apparatus of FIG. 1.

FIG. 4*a* illustrates driving signals of the plasma display apparatus.

The scan driver 110 supplies, to the scan electrode, a rising ramp signal gradually rising to a sum voltage Vs+Vsetup, which is the summation of a sustain voltage Vs and a setup voltage Vsetup, during a setup period of a reset period. The sustain voltage Vs is the highest voltage of a sustain signal.

The rising ramp signal generates a weak dark discharge, i.e., a setup discharge, in the discharge cells. As a result of the setup discharge, wall charges sufficient for the generation of an address discharge are accumulated within the discharge cells. The slope of the rising ramp signal may range between 0.0005V/nsec and 0.005V/nsec.

The scan driver supplies a falling ramp signal gradually falling from a positive voltage, which is lower than the sum voltage Vs+Vsetup, during a setdown period. The falling ramp signal generates a weak erase discharge, i.e., a setdown discharge, within the discharge cells. As a result of the setdown discharge, some of the wall charges accumulated within the discharge cells are erased. The slope of the falling ramp signal may range between −0.0005V/nsec and −0.005V/nsec.

The scan driver 110 supplies to the scan electrode a scan signal which falls from a scan reference voltage Vsc to a scan voltage −Vy, is maintained at the scan voltage −Vy, and rises to the scan reference voltage Vsc.

The data driver 120 supplies a first data signal and a second data signal, which correspond to the scan signal, to the first address electrode and the second address electrode respectively. The first and second address electrodes are adjacent to each other. The first data signal and the second data signal are supplied at different supply time points t1, t2. The first data signal or the second data signal gradually rises to a data voltage Vd during a first period, is maintained at the data voltage Vd during a second period, and gradually falls from the data voltage Vd during a third period.

The durations of the first and the third periods may be between 5% and 20% of the duration of the second period. The durations of the first and the third periods may be between between 50 nsec and 200 nsec. The slope of the data signal during the first period may range between 0.1V/nsec and 1V/nsec. The slope of the data signal during the third period may range between −0.1 V/nsec and −1V/sec.

When the first data signal or the second data signal as above is supplied, noise and Electro Magnetic Interference due to a voltage variation are reduced because the voltage on the first address electrode and the second address electrode varies gradually.

Also, the supply of the first and second data signals at different supply start time points t1 and t2 reduces noise. When the data signals are supplied at the same supply start time point, the voltage difference between the data signals and the scan signal increases noise. On the other hand, when the data signals are supplied at the different supply start time points t1 and t2, noises generated by the voltage difference of the data signals and the scan signal are spread in time, and the whole noise is reduced.

When the difference Δt between the supply start time points t1 and t2 of the data signals may range from 0.2 times to 1 times the duration of the first period, the noise and the electro magnetic interference are effectively reduced.

When the difference Δt between the supply start time points t1 and t2 of the data signals ranges from 0.4 times to 0.8 times the duration of the first period, the scan signal and the data signals sufficiently overlap for a stable address discharge, and at the same time, the noise and the electro magnetic interference are reduced.

When the difference Δt between the supply start time points t1 and t2 ranges from 10 ns to 300 ns, the noise and the electro magnetic interference are reduced, while preventing an excessive increase of the address period.

The supply start time points t1 and t2 of the data signals may be different from the supply start time point t3 of the scan signal. Then, the noise generated between the scan electrode and the first address electrode or the second electrode is reduced.

The sustain driver 115 supplies a sustain bias voltage Vzb to the sustain electrode during the address period. The sustain bias voltage Vzb prevents the occurrence of an erroneous discharge generated by the interference between the sustain electrode and the scan electrode during the address period.

The scan driver 110 and the sustain driver 115 supply sustain signals to the scan electrode and the sustain electrode during the sustain period. As a result of the supply of the sustain signals, the discharge cells selected during the address period emit light. In another implementation, the scan driver 110 may supply a sustain signal swinging from a positive sustain voltage to a negative sustain voltage to the scan electrode and the sustain driver 115 may supply a ground level voltage to the sustain electrode during the sustain period.

Figure 4B:
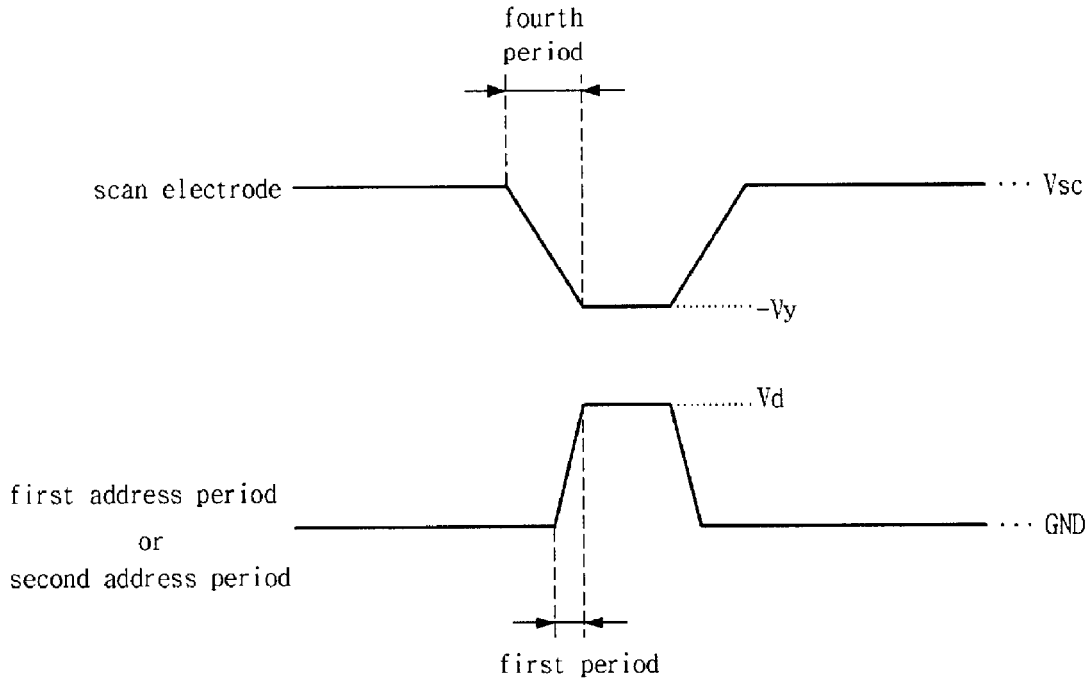
FIG. 4*b* is a graph of a scan signal and a data signal of the plasma display apparatus of FIG. 1.

FIG. 4*b* illustrates exemplary waveforms of the scan signal and the data signal. As illustrated in FIG. 4*b*, the scan signal may gradually fall from the scan reference voltage Vsc to the scan voltage −Vy during a fourth period. The slope of the data signal during the first period may be different from that of the scan signal during the fourth period.

When the voltage on the scan electrode and the voltage on the address electrode change gradually and the slope of the scan signal during the fourth period is different from the slope of the data signal during the first period, noise is reduced.

Figure 5:
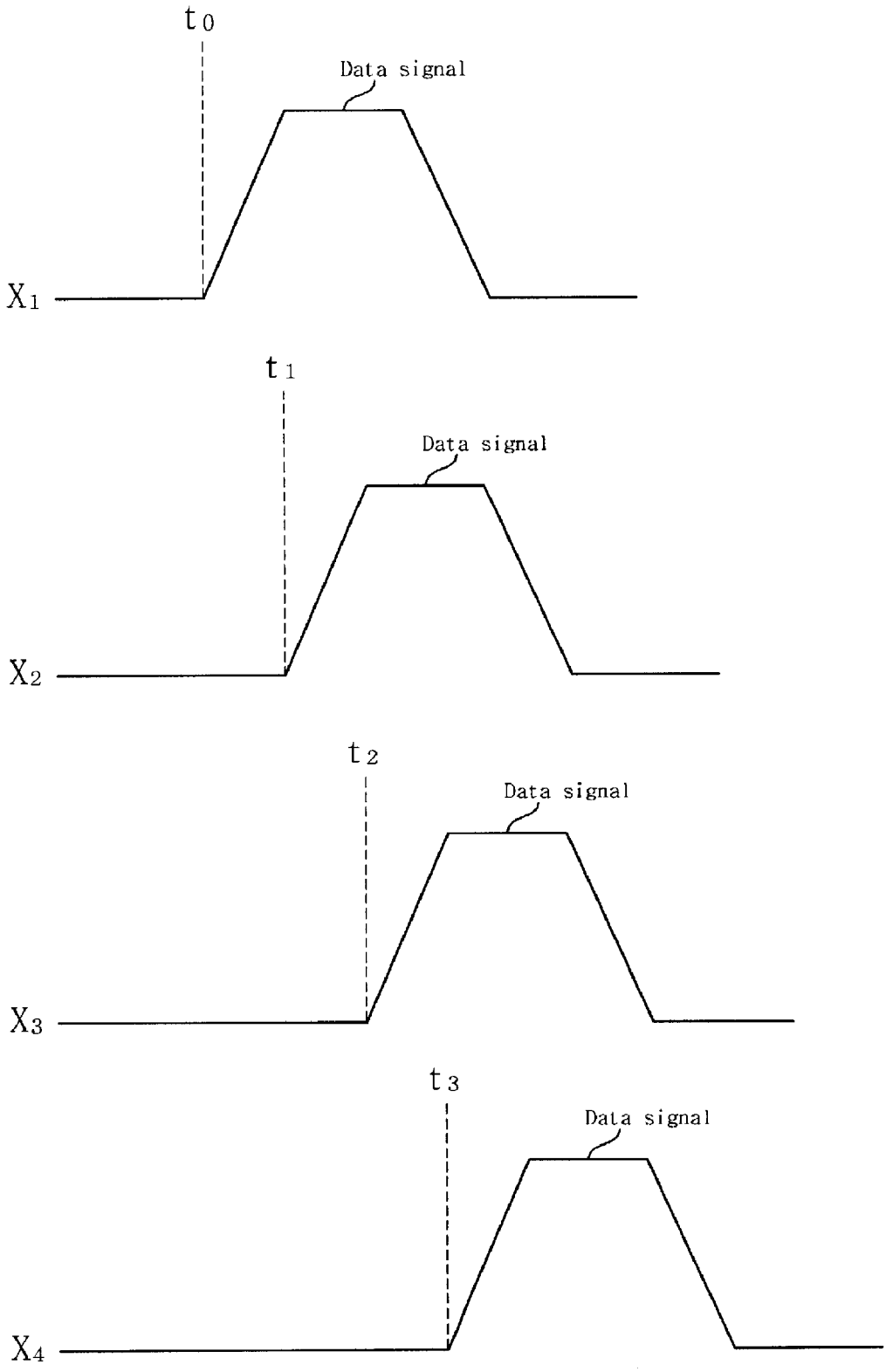
FIG. 5 is a graph of data signals of the plasma display apparatus of FIG. 1.

FIG. 5 illustrates supply start time points of data signals supplied to address electrodes. As illustrated in FIG. 5, data signals are applied to address electrodes X1, X2, X3 and X4 at different supply start time points t0, t1, t2 and t3, respectively. As a result, the noise is reduced.

Figure 6:
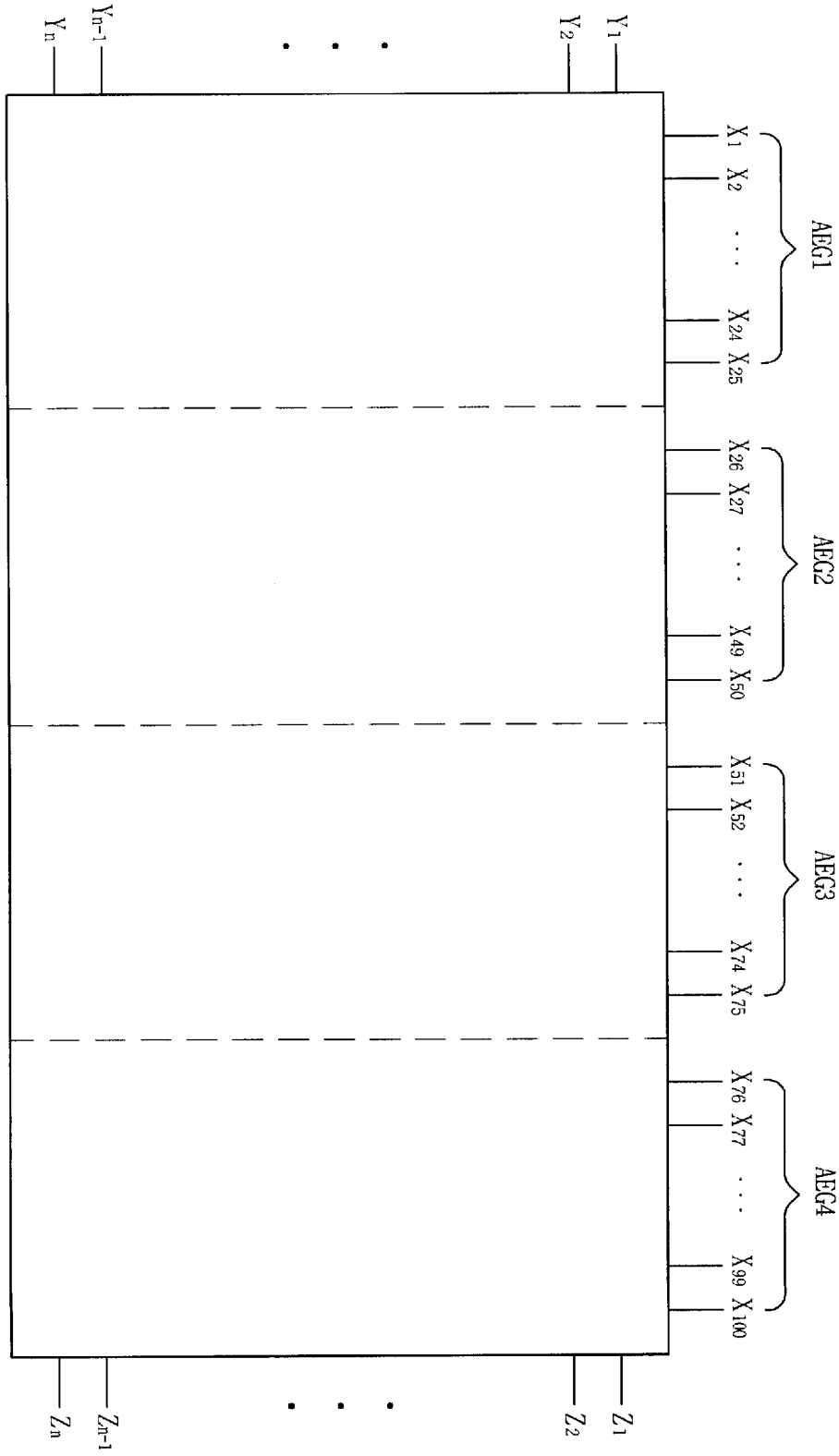
FIG. 6 is a schematic diagram of electrodes in the plasma display panel of FIG. 2.

The plasma display panel of the plasma display apparatus may include address electrodes which are divided into address electrode groups. Dada signals are supplied simultaneously to address electrodes in the same address electrode group. However, data signals are supplied at different times to address electrodes in different address electrode groups. FIG. 6 illustrates an exemplary grouping of address electrodes. The plasma display panel of FIG. 6 includes 4 address electrode groups AEG1 to AEG4. The number of address electrodes in each address electrode group may be same or different.

Figure 7:
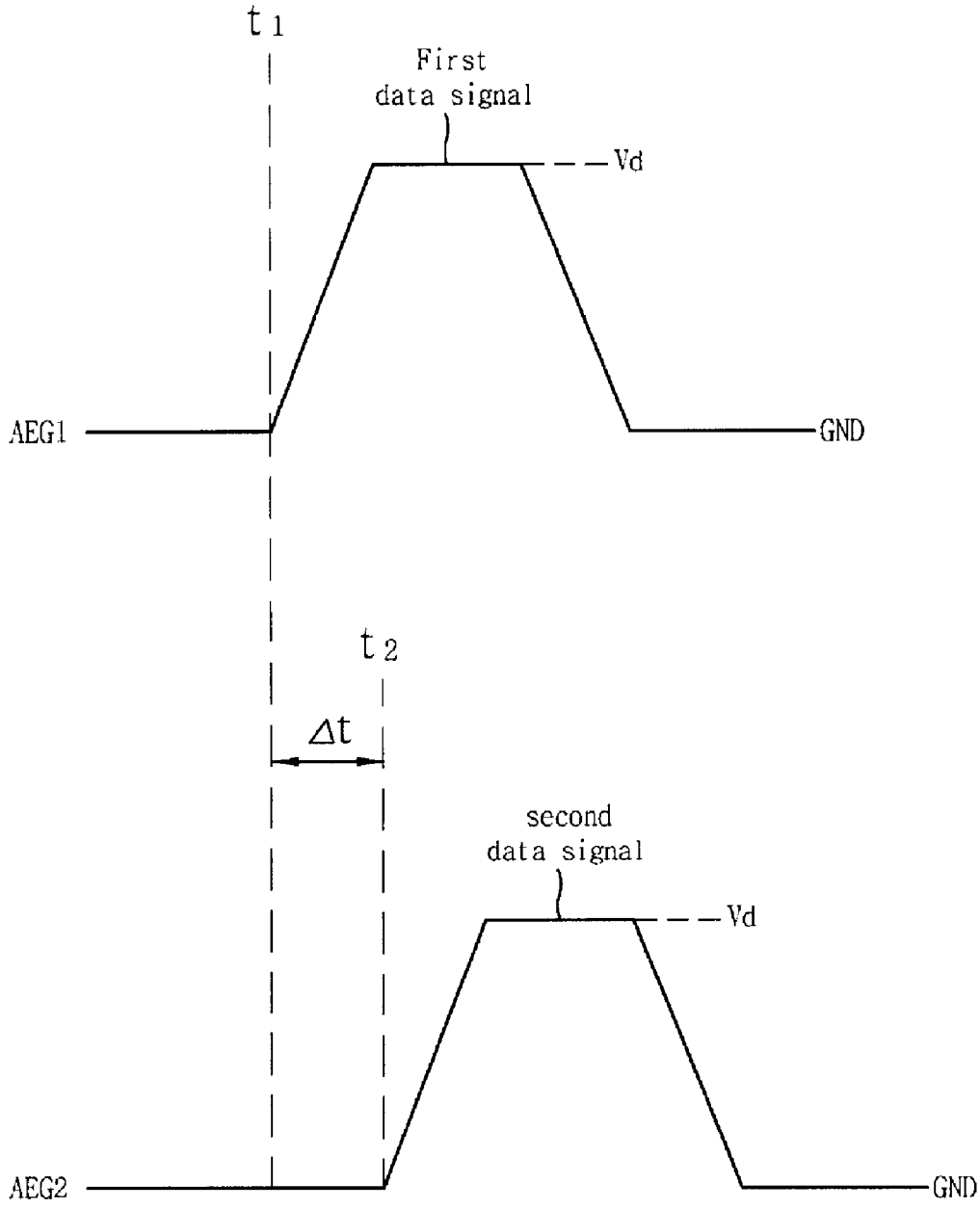
FIG. 7 is a graph of data signals of the plasma display apparatus of FIG. 1.

FIG. 7 illustrates first and second data signals. As illustrated in FIG. 7, a first data signal is supplied to address electrodes of address electrode group AEG1 at a supply start time point t1, and a second data signal is supplied to address electrodes of address electrode group AEG2 at a supply start time point t2. By supplying the data signals at different times to address electrodes of different address electrode groups, the noise generated between the scan electrodes and the address electrodes is reduced.

Figure 8A:
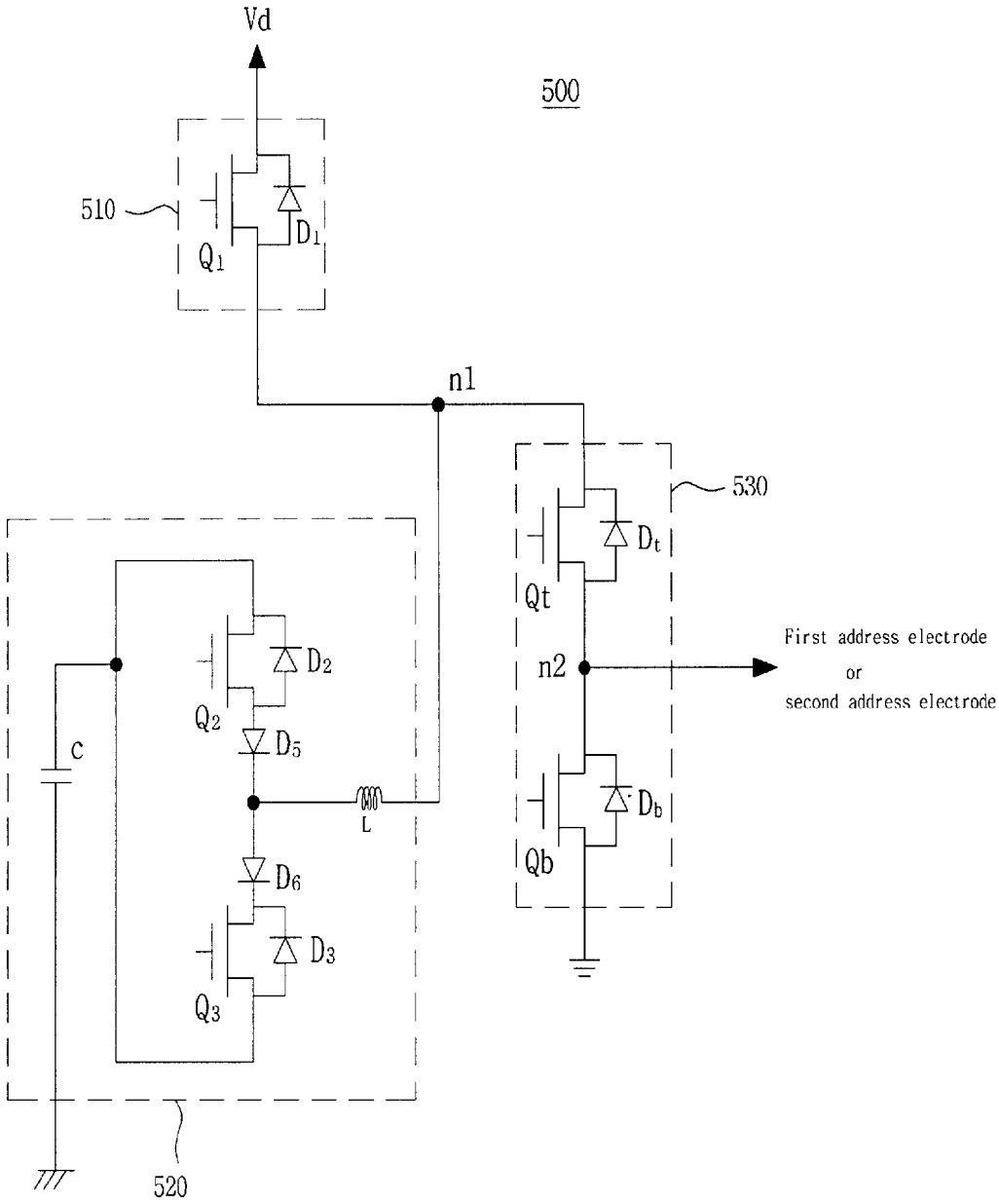
FIG. 8*a* is a circuit diagram of a basic unit of a data driver of the plasma display apparatus of FIG. 1.
Figure 8B:
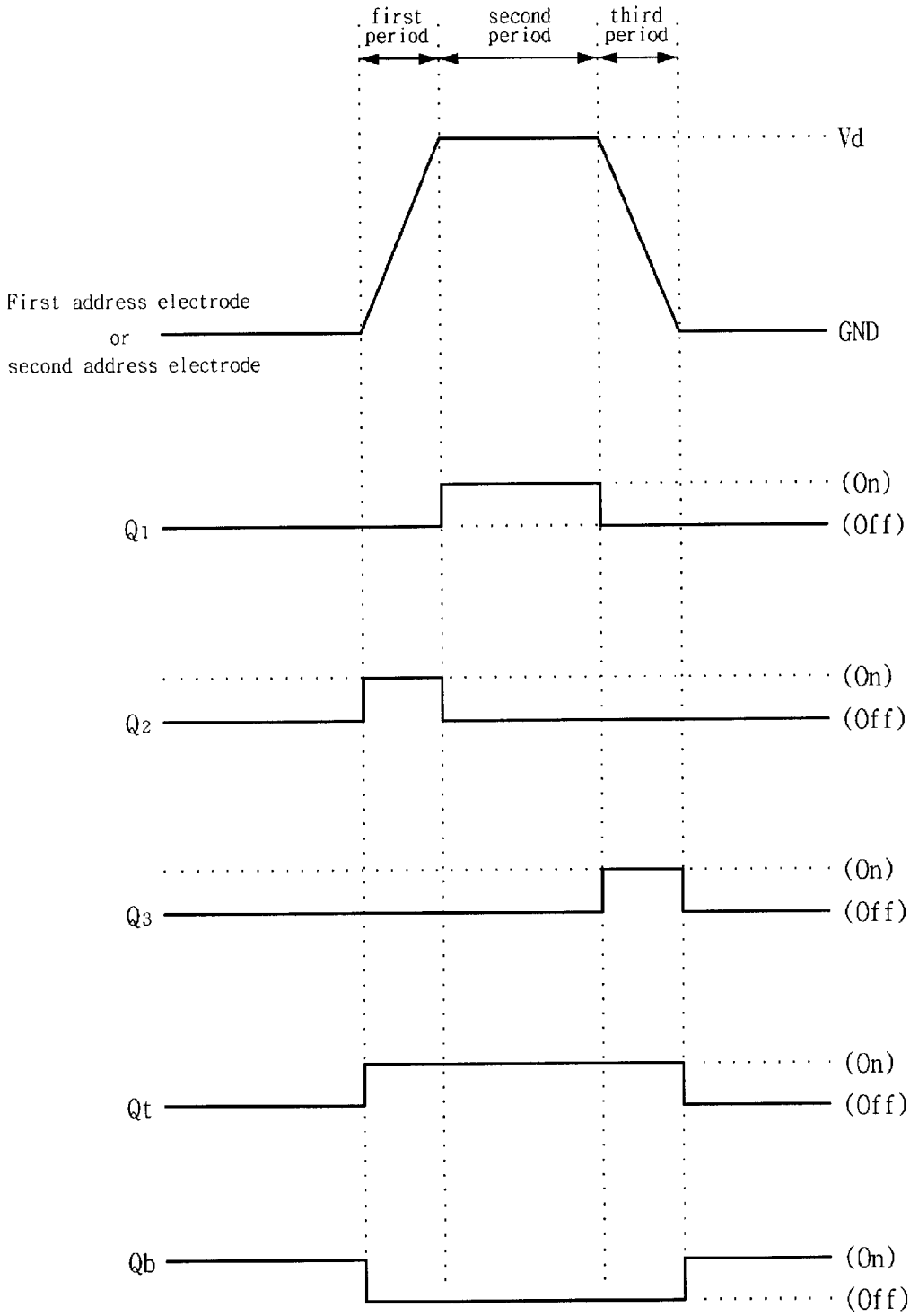
FIG. 8*b* is a switching timing diagram of the data driver of FIG. 8*a;*

FIG. 8*a* illustrates an exemplary structure of the basic unit 500 of the data driver of the plasma display apparatus and FIG. 8*b* illustrates a switching timing diagram of the data driver of FIG. 8*a*. The data driver includes basic units for each address electrode.

As illustrated in FIG. 8*a*, the basic unit 500 of the data driver of the plasma display apparatus includes a data drive integrated circuit 530 connected to the first address electrode or the second address electrode, a data voltage supply unit 510 for supplying a data voltage Vd to the first address electrode or the second address electrode through the data drive integrated circuit 530, and an energy recovery unit 520 for gradually increasing a voltage of the first address electrode or the second address electrode to the data voltage Vd or decreasing the voltage of the first address electrode or the second address electrode from the data voltage Vd.

The operation of the data driver basic unit 500 in FIG. 8*a* to generate a data signal is explained below with reference to FIG. 8*b*. As illustrated in FIG. 8*b*, when a switch Q2 and a switch Qt are turned on during the first period, an energy stored at a capacitor C is supplied to the first address electrode or the second address electrode through the switch Q2, an inductor L and the switch Qt. The inductor L forms a resonance, and the voltage on the first address electrode or the second address electrode gradually rises from a ground level voltage GND to a data voltage Vd.

When a switch Q1 and the switch Qt are turned on and the other switches are turned off during the second period, the data voltage Vd is supplied to the first address electrode or the second address electrode. A voltage on the first address electrode or the second address electrode is maintained at the data voltage Vd.

When a switch Q3 and the switch Qt are turned on and the other switches are turned off during the third period, the capacitor C recovers the energy from the first address electrode or the second address electrode through the switch Qt, the inductor L, and the switch Q3. The inductor L forms a resonance, and the voltage on the first address electrode or the second address electrode gradually falls from the data voltage Vd to the ground level voltage GND.

When the switch Qb is turned on and the other electrodes are turned off at the end of the third period, the ground level voltage GND is supplied to the first address electrode or the second address electrode.

Diodes D1, D2, D3, Dt and Db of FIG. 8*a* are body diodes of the switches Q1, Q2, Q3 Qt and Qb respectively. Diodes D5 and D6 cut off a reverse current.

Figure 9A:
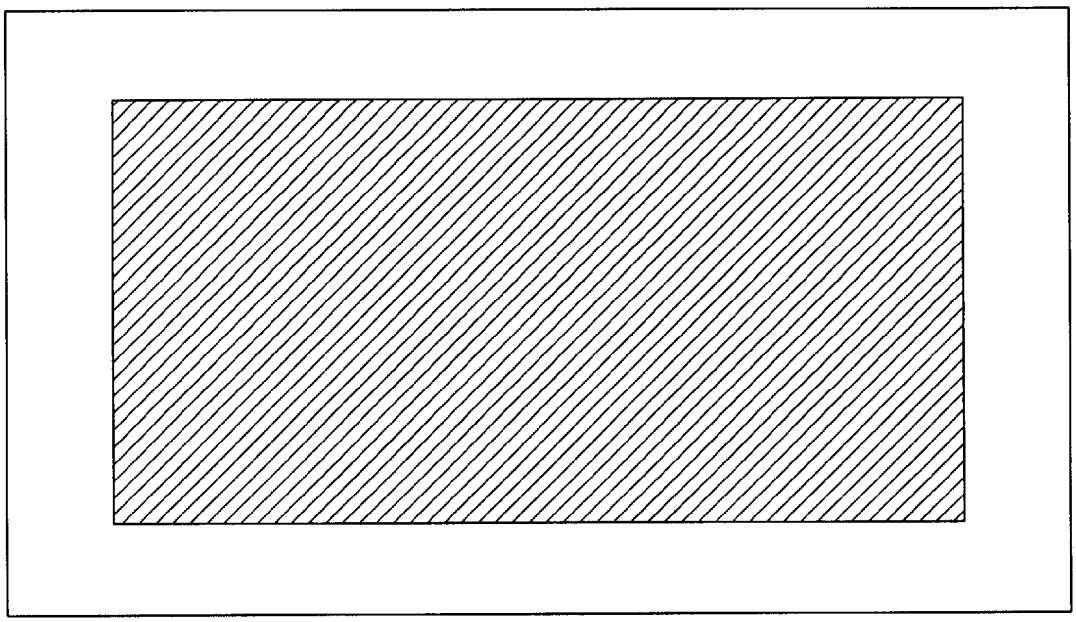
FIG. 9*a* and FIG. 9*b* are images displayed on the plasma display apparatus of FIG. 1.
Figure 9B:
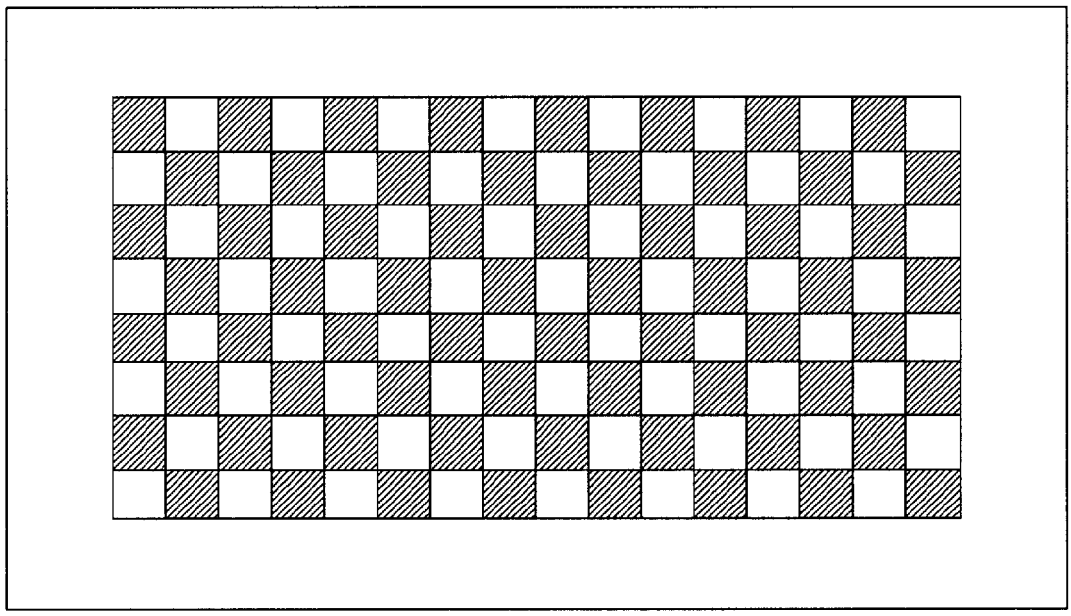

FIG. 9*a* and FIG. 9*b* are screen images displayed by the plasma display apparatus to explain the relationship between the switching operation and the load of the data driver basic unit.

FIG. 9*a* illustrates a full black image displayed by the plasma display apparatus. In order to display the full black image of FIG. 9*a*, the switches Qb and Qt of the data drive integrated circuit 530 in FIG. 8*a* respectively maintains a turn-on state and a turn-off state. Thus, the switching operation of the data driver basic unit is not performed, and the load substantially is equal to 0. That is to say, a switching frequency is substantially equal to 0, and the load substantially is equal to 0.

FIG. 9*b* illustrates a lattice pattern image displayed by the plasma display apparatus. In order to display the lattice pattern image, the switching frequency of the switch Qt and the switch Qb of FIG. 8*a* and the load of the data driver basic unit 500 become the maximum. The load is proportional to the switching frequency.

As the switching frequency increases, a noise and an electro magnetic interference increase. In order to decrease the noise and the electro magnetic interference, the data driver 120 may supply the data signals to the first address electrode and the second address electrode at different supply time points according to the load of each address electrode, which is proportional to the switching frequency of the data driver basic unit for each address electrode.

Figure 10A:
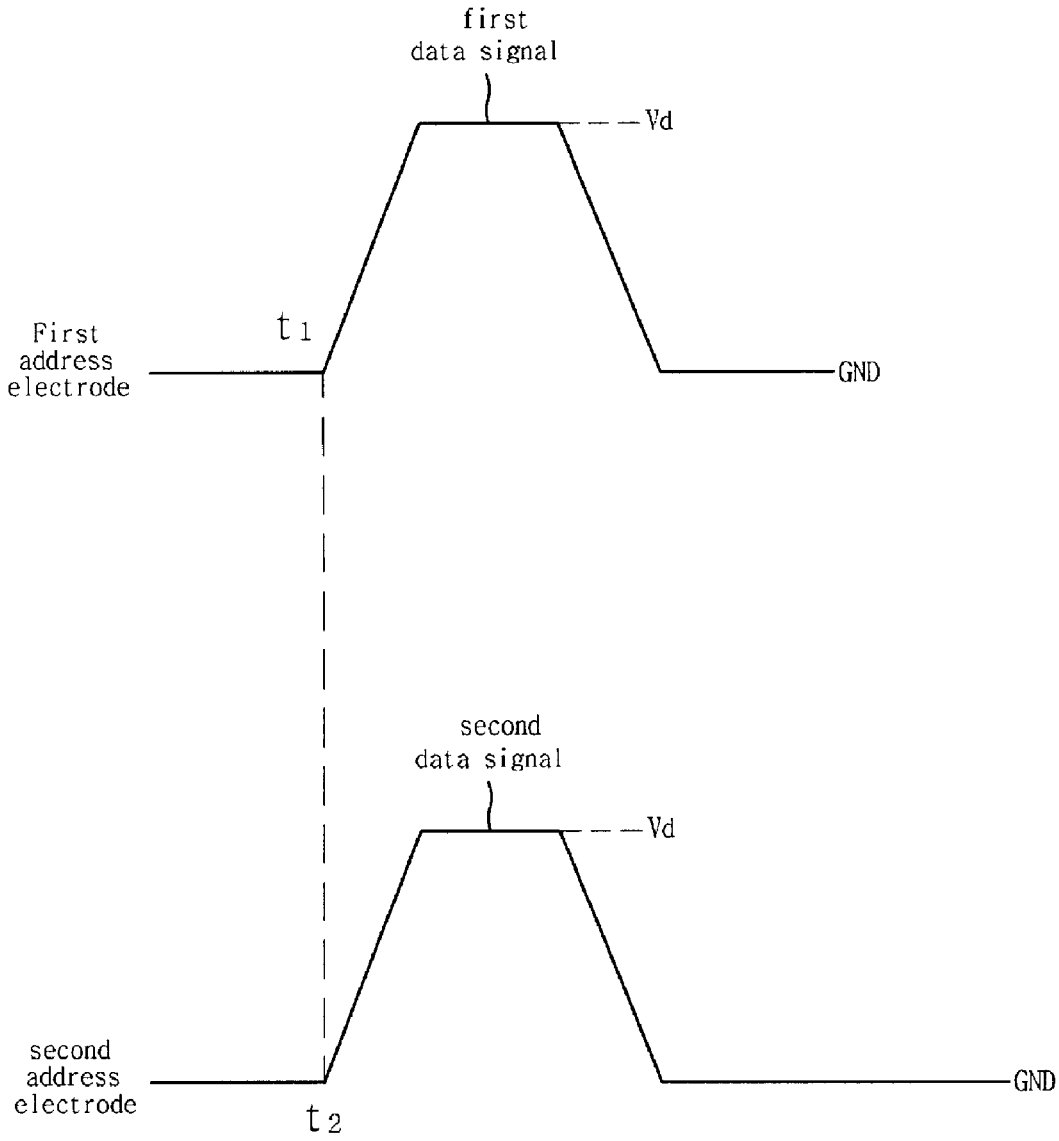
FIGS. 10*a*, 10*b* and 11 are graphs of data signals.

The supply time point of the data signal may be adjusted based on the load. For example, as illustrated in FIG. 10*a*, when the load is less than a threshold, a supply start time point t1 of the first data signal for the first address electrode is substantially the same as a supply start time point t2 of the second data signal for the second address electrode. FIG. 10*a* may correspond to FIG. 9*a*.

Figure 10B:
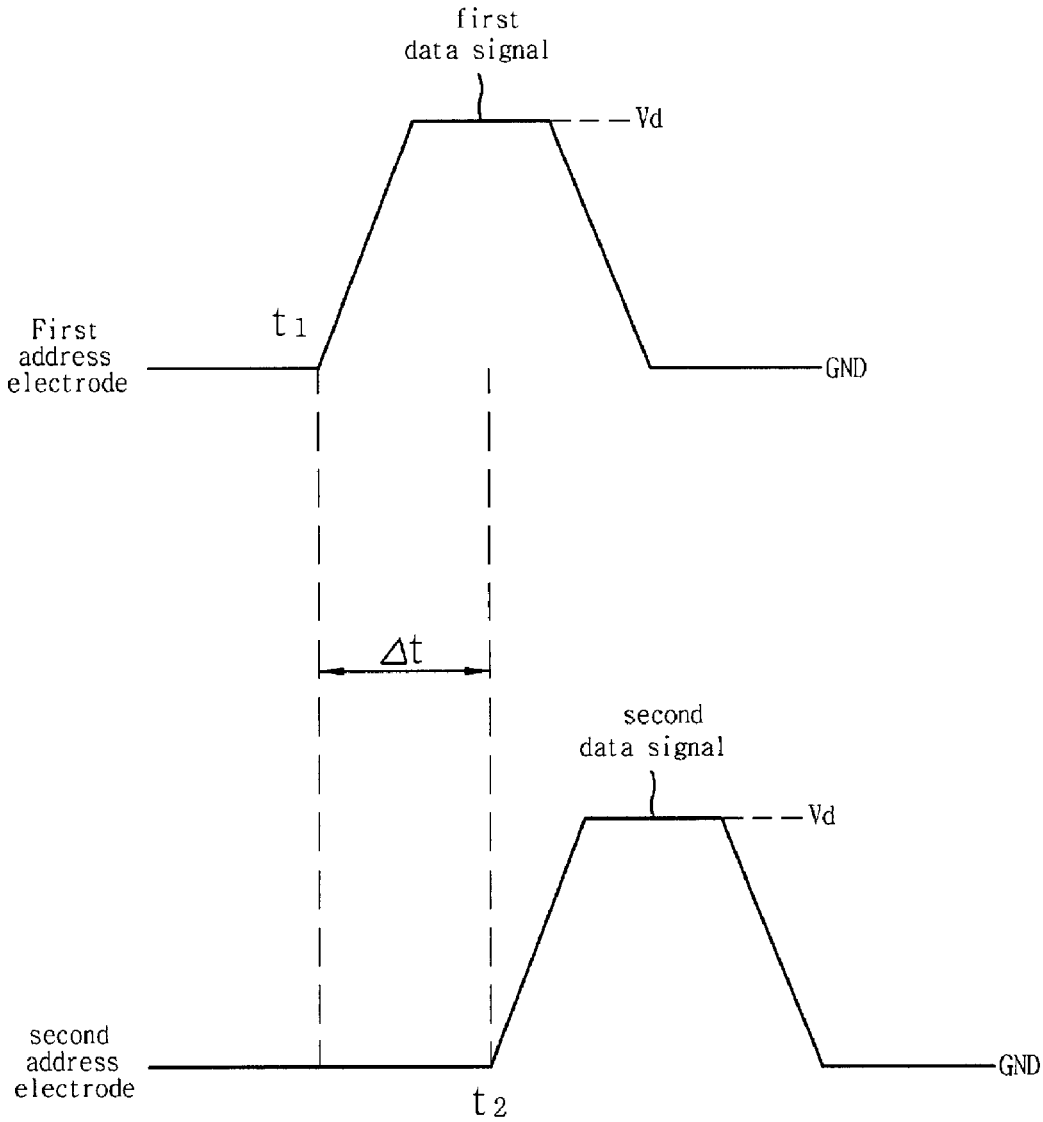

For example, as illustrated in FIG. 10*b*, when the load is greater than the threshold, a supply start time point t1 of the first data signal for the first address electrode is earlier than a supply start time point t2 of the second data signal for the second address electrode. When the difference of the supply start time points t1 and t2 ranges from 10 ns to 300 ns, the noise and the electro magnetic interference are reduced. To implement this, the data driver basic unit 500 of FIG. 8*a* may further include a detection circuit to detect the load of the electrode and adjust the supply start time point accordingly. FIG. 10*b* may correspond to FIG. 9*b*.

Figure 11:
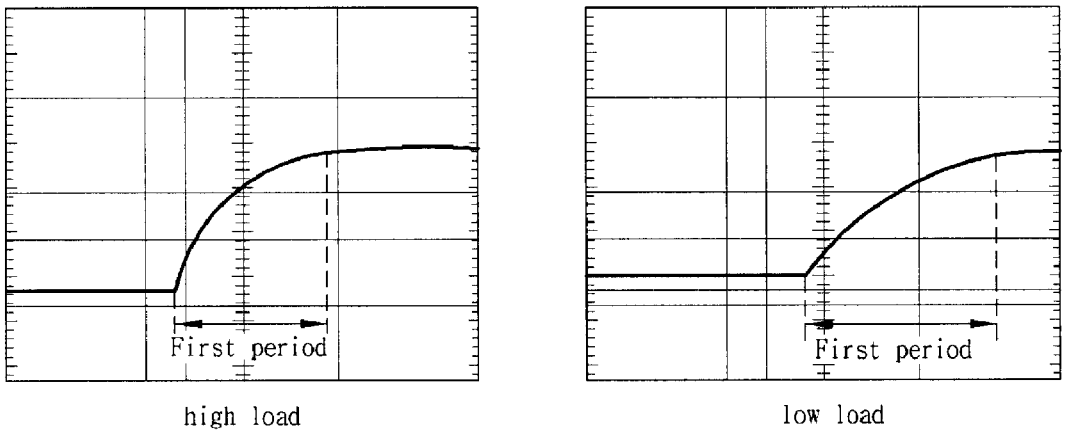

FIG. 11 illustrates an exemplary relationship between the first period of the data signal and the load. The duration and the supply start time point of the data signal may be adjusted based on the load. For example, as illustrated in FIG. 11, the first period of the data signal for a high load is shorter than that for a low load. When the duration of the first period of a data signal for the lowest load ranges from 1.5 times to 5 times the duration of the first period of a data signal for the highest load, the noise and the electro magnetic interference are reduced. Therefore, a stable address discharge is generated and a driving efficiency improves. When the duration of the first period for the lowest load ranges from 2 times to 4 times the duration of the first period for the highest load, an excessive increase of the address period is prevented. In order to implement these features, the data driver basic unit 500 of FIG. 8*a* may further include a detection circuit to detect the load and adjust the duration of the first period of the data signal accordingly.

Other implementations are within the scope of the following claims.

What is claimed is:

1. A plasma display apparatus comprising:

a plasma display panel including a scan electrode, a first address electrode and a second address electrode;

a data driver initiating a change in a voltage value of a first data signal supplied to the first address electrode at a first initiation time and initiating a change in a voltage value of a second data signal supplied to the second address electrode at a second initiation time, with each of the data signals gradually changing from a first data voltage to a second data voltage during a respective first period, maintaining at the second data voltage during a respective second period, and gradually changing from the second data voltage to the first data voltage during a respective third period; and a scan driver initiating a change in a voltage value of a scan signal supplied to the scan electrode at a third initiation time, wherein the data driver includes:

a load detector to detect a load of the first address electrode or the second address electrode, the load being within either a first load range or a second load range higher than the first load range, and a data drive integrated circuit connected to the first address electrode or the second address electrode, the data drive integrated circuit including a first switch controlling application of the data signals, and a second switch controlling application of the first data voltage, wherein the first switch is turned on while each of the data signals are applied, and the second switch is turned off while each of the data signals are applied, wherein the detected load of the first address electrode or the second address electrode is proportional to a switching frequency at which the first switch and the second switch are turned on or turned off, wherein the first initiation time is substantially the same as the second initiation time when the detected load is within the first load range, and the first initiation time is earlier than the second initiation time when the detected load is within the second load range, wherein, when the detected load is within the second load range, a time interval between the first initiation time and the second initiation time is less than or equal to a duration of the first period for the first data signal, and wherein the third initiation time is earlier than the first and second initiation times.

2. The plasma display apparatus of claim 1, wherein the first and second address electrodes are adjacent to each other.

3. The plasma display apparatus of claim 1, wherein a duration of the respective first period is between 5% and 20% of a duration of the respective second period.

4. The plasma display apparatus of claim 1, wherein a slope of each of the data signals during the respective first period ranges between 0.1V/ns and 1V/ns.

5. The plasma display apparatus of claim 1, wherein, when the detected load is within the second load range, the time interval between the first initiation time and the second initiation time ranges from 0.2 times to 1 times the duration of the first period for the first data signal.

6. The plasma display apparatus of claim 1, wherein the scan signal gradually changes from a first scan voltage to a second scan voltage during a fourth period, maintains at the second scan voltage during a fifth period, and gradually changes from the second scan voltage to a third scan voltage during a sixth period.

7. The plasma display apparatus of claim 6, wherein a slope of the scan signal during the fourth period is different from a slope of the first data signal during the first period, a duration of the respective first period is shorter than a duration of the fourth period, an end time of the respective second period is substantially the same as an end time of the fifth period, and the a duration of the fifth period is substantially equal to a duration of the first period.

8. The plasma display apparatus of claim 1, wherein the first initiation time and second initiation time are determined based on the load of the first address electrode and the load of the second address electrode.

9. The plasma display apparatus of claim 1, wherein the data driver further includes:

a data voltage supply unit configured to supply the second data voltage to the first address electrode or the second address electrode through the data drive integrated circuit; and an energy recovery unit configured to supply the first data signal to the first address electrode or to supply the second data signal to the second address electrode during the respective first period and the respective third period.

10. The plasma display apparatus of claim 1, wherein the plasma display panel has a first group of address electrodes that includes the first address electrode and a second group of address electrodes that includes the second address electrode, and wherein the first data signal is supplied to each address electrode of the first group and the second data signal is supplied to each address electrode of the second group.

11. The plasma display apparatus of claim 1, wherein the data driver includes a resonant circuit to supply the first data signal to the first address electrode during the first period and the third period.

12. The plasma display apparatus of claim 1, wherein the duration of the respective first period when a minimum load is applied ranges from 1.5 times to 5 times the duration of the respective first period when a maximum load is applied.

13. The plasma display apparatus of claim 1, wherein the difference between the first initiation time and the second initiation time ranges from 0.4 times to 0.8 times the duration of the first period for the first data signal.

14. The plasma display apparatus of claim 1, wherein the difference between the first initiation time and the second initiation time ranges from 10 ns to 300 ns.

15. The plasma display apparatus of claim 1, wherein the difference between the first initiation time and the second initiation time is less than the duration of the first period for the first data signal.

16. The plasma display apparatus of claim 1, wherein the data driver is configured to:

access a threshold associated with a load of the first address electrode or the second address electrode;

compare the detected load of the first address electrode or the second address electrode to the accessed threshold;

determine, based on the comparison, that the detected load falls within the first load range when the detected load is below the accessed threshold and that the detected load falls within the second load range when the detected load is above the accessed threshold;

control the first initiation time to be substantially the same as the second initiation time when the detected load is within the first load range, and controlling the first initiation time to be earlier than the second initiation time when the detected load is within the second load range;

control, when the detected load is within the second load range, a time interval between the first initiation time and the second initiation time to be less than or equal to a duration of the first period for the first data signal; and control the third initiation time to be earlier than the first and second initiation times.

17. A method of driving a plasma display apparatus including a scan electrode, a first address electrode and a second address electrode, the method comprising:

detecting a load of the first address electrode or the second address electrode, the load being within either a first load range or a second load range higher than the first load range;

initiating a change in a voltage value of a first data signal supplied to the first address electrode at a first initiation time;

initiating a change in a voltage value of a second data signal supplied to the second address electrode at a second initiation time; and initiating a change in a voltage value of a scan signal supplied to a scan electrode at a third initiation time, wherein each of the data signals gradually changes from a first data voltage to a second data voltage during a respective first period, maintains at the second data voltage during a respective second period, and gradually changes from the second data voltage to a third the first data voltage during a respective third period, wherein a data driver includes a data drive integrated circuit connected to the first address electrode or the second address electrode, the data drive integrated circuit including a first switch controlling application of the data signals, and a second switch controlling application of the first data voltage, wherein the first switch is turned on while the data signals are applied, and the second switch is turned off while the data signals are applied, wherein the detected load of the first address electrode or the second address electrode is proportional to a switching frequency at which the first switch and the second switch are turned on or turned off, wherein the first initiation time is substantially the same as the second initiation time when the detected load is within the first load range, and the first initiation time is earlier than the second initiation time when the detected load is within the second load range, wherein, when the detected load is within the second load range, a time interval between the first initiation time and the second initiation time is less than or equal to a duration of the first period for the first data signal, and wherein the third initiation time is earlier than the first and second initiation times.

18. The method of claim 17, wherein, when the detected load is within the second load range, the time interval between the first initiation time and the second initiation time ranges from 0.2 times to 1 times the duration of the first period for the first data signal.

19. The method of claim 17, wherein the scan signal gradually changes from a first scan voltage to a second scan voltage during a fourth period, maintains at the second scan voltage during a fifth period, and gradually changes from the second scan voltage to a third scan voltage during a sixth period.

20. The method of claim 19, wherein a slope of the scan signal during the fourth period is different from a slope of the first data signal during the first period, a duration of the respective first period is shorter than a duration of the fourth period, an end time of the respective second period is substantially the same as an end time of the fifth period, and the a duration of the fifth period is substantially equal to a duration of the first period.

21. The method of claim 17, further comprising:

supplying the first data signal to a first group of address electrodes including the first address electrode; and supplying the second data signal to a second group of address electrodes including the second address electrode.

22. The method of claim 17, wherein the difference between the first initiation time and the second initiation time ranges from 0.4 times to 0.8 times the duration of the first period for the first data signal.

23. The method of claim 17, wherein the difference between the first initiation time and the second initiation time ranges from 10 ns to 300 ns.

24. The method of claim 17, further comprising:

accessing a threshold associated with a load of the first address electrode or the second address electrode;

comparing the detected load of the first address electrode or the second address electrode to the accessed threshold;

determining, based on the comparison, that the detected load falls within the first load range when the detected load is below the accessed threshold and that the detected load falls within the second load range when the detected load is above the accessed threshold;

controlling the first initiation time to be substantially the same as the second initiation time when the detected load is within the first load range, and controlling the first initiation time to be earlier than the second initiation time when the detected load is within the second load range;

controlling, when the detected load is within the second load range, a time interval between the first initiation time and the second initiation time to be less than or equal to a duration of the first period for the first data signal; and controlling the third initiation time to be earlier than the first and second initiation times.

25. A plasma display apparatus comprising:

a plasma display panel including a scan electrode, a first address electrode and a second address electrode;

a data driver initiating a change in a voltage value of a first data signal supplied to the first address electrode at a first initiation time and initiating a change in a voltage value of a second data signal supplied to the second address electrode at a second initiation time, with each of the data signals gradually changing from a first data voltage to a second data voltage during respective first period, maintaining at the second data voltage during a respective second period, and gradually changing from the second data voltage to the first data voltage during a respective third period; and a scan driver initiating a change in a voltage value of a scan signal supplied to the scan electrode at a third initiation time, wherein the data driver includes:

a load detector to detect a load of the first address electrode or the second address electrode, the load being within either a first load range or a second load range higher than the first load range, and a data drive integrated circuit connected to the first address electrode or the second address electrode, the data drive integrated circuit including a first switch controlling application of the data signals, and a second switch controlling application of the first data voltage, wherein the first switch is turned on while the data signals is applied, and the second switch is turned off while the data signals is applied, wherein the detected load of the first address electrode or the second address electrode is proportional to a switching frequency at which the first switch and the second switch are turned on or turned off, wherein the third initiation time is earlier than the first and second initiation times, a slope of the scan signal during the fourth period being different from a slope of the first data signal during the first period, and wherein a duration of the first period when the detected load is within the second load range is shorter than a duration of the first period when the detected load is within the first load range.

26. The plasma display apparatus of claim 25, wherein the data driver is configured to:

access a threshold associated with a load of the first address electrode or the second address electrode;

compare the detected load of the first address electrode or the second address electrode to the accessed threshold;

determine, based on the comparison, that the detected load falls within the first load range when the detected load is below the accessed threshold and that the detected load falls within the second load range when the detected load is above the accessed threshold;

control the third initiation time to be earlier than the first and second initiation times;

control a slope of the scan signal during the fourth period to be different from a slope of the first data signal during the first period; and control a duration of the first period when the detected load is within the second load range to be shorter than a duration of the first period when the detected load is within the first load range.

* * * * *